US007472503B2

(12) United States Patent
Maher

(10) Patent No.: US 7,472,503 B2
(45) Date of Patent: Jan. 6, 2009

(54) ATTACHMENT SYSTEM

(75) Inventor: Patrick Gerard Maher, Kalgoorlie (AU)

(73) Assignee: Sandvik Shark Pty Ltd., Eagle Farm (AU)

( * ) Notice: Subject to any disclaimer, the term of this patent is extended or adjusted under 35 U.S.C. 154(b) by 211 days.

(21) Appl. No.: 10/509,016

(22) PCT Filed: Mar. 26, 2003

(86) PCT No.: PCT/AU03/00362

§ 371 (c)(1),
(2), (4) Date: Apr. 7, 2005

(87) PCT Pub. No.: WO03/080946

PCT Pub. Date: Oct. 2, 2003

(65) Prior Publication Data

US 2005/0229441 A1 Oct. 20, 2005

(30) Foreign Application Priority Data

Mar. 26, 2002 (AU) ..... PS1348
Jul. 12, 2002 (AU) ..... 2002950166

(51) Int. Cl.
*E02F 9/28* (2006.01)

(52) U.S. Cl. ..... 37/455; 37/458; 37/452; 403/374.4

(58) Field of Classification Search ..... 37/446–460; 403/374.3, 374.4, 374.1, 379.3, 379.4
See application file for complete search history.

(56) References Cited

U.S. PATENT DOCUMENTS 1,485,879 A * 3/1924 Page ..... 37/455
1,697,536 A * 1/1929 Miley ..... 37/455
1,783,350 A * 12/1930 Watts ..... 37/454
2,311,463 A * 2/1943 Page ..... 37/455
2,385,395 A * 9/1945 Baer ..... 37/458
2,393,706 A * 1/1946 Page ..... 37/455
3,371,437 A * 3/1968 Wilson et al. ..... 37/455
4,205,469 A * 6/1980 Johansson et al. ..... 37/457
4,642,920 A * 2/1987 Lehnhoff ..... 37/452
4,748,754 A * 6/1988 Schwappach ..... 37/451
5,579,594 A 12/1996 Pasqualini et al.
5,653,048 A * 8/1997 Jones et al. ..... 37/452
5,713,145 A * 2/1998 Ruvang ..... 37/458
5,926,982 A 7/1999 Keech et al.
6,209,238 B1 4/2001 Ruvang
6,240,663 B1 6/2001 Robinson
6,729,052 B2 * 5/2004 Ollinger, IV et al. ..... 37/452
6,839,990 B2 * 1/2005 Leslie et al. ..... 37/452

FOREIGN PATENT DOCUMENTS

WO WO 02/12642 2/2002

* cited by examiner

*Primary Examiner*—Thomas A Beach
(74) *Attorney, Agent, or Firm*—Venable LLP; Robert Kinberg; Justine A. Gozzi

(57) ABSTRACT

An attachment system for connecting a first member such as a lip plate (12) of a mechanical digging device to a second member such as a ground engaging tool (10). The first member has a lug (22) attached thereto, and the second member has a recess (50) which is located about the lug (22). A stabilizing member (98) is located within a slot (57) in the recess. A clamping member (60) is between the lug and the stabilizing member, and includes a resilient portion (90) such as a compression spring. A compressive force supplied to the resilient portion restricts the movement of the second member relative to the lug.

20 Claims, 8 Drawing Sheets

ATTACHMENT SYSTEM

FIELD OF THE INVENTION

The present invention relates to an attachment system, particularly intended for the attachment of ground engaging tools to the lip plate of mechanical digging devices. Many mining and earthmoving operations require the use of mechanical digging devices, such as front-end loaders. Such mechanical digging devices commonly feature buckets which can be manipulated by a user to dig into earth or rocks to be shifted. These buckets include a lip plate across the bucket floor. On this lip are mounted a series of ground engaging tools having a tooth-like appearance. These tools, in use, penetrate into the material being dug, and provide a leading edge for the bucket to follow.

The ground engaging tools are highly susceptible to wear due to the high level of friction generated by their use. Accordingly, it is often desirable to be able to remove a worn ground engaging tool and substitute a new tool.

A common method of attachment for ground engaging tools is that of welding. In practice, however, a welded ground engaging tool can be difficult to replace without substantial dismantling of the bucket.

Mechanical methods of attaching ground engaging tools through the use of restraining bolts and pins have been proposed. These methods are often difficult to use in practice, as the forces generated against a ground engaging tool can cause deformation of the bolt or pin, thus making subsequent disengagement difficult.

The present invention attempts to overcome at least in part some of the aforementioned disadvantages of previous attachment system for ground engaging tools.

SUMMARY OF THE PRESENT INVENTION

In accordance with one aspect of the present invention there is provided an attachment system for connecting a first member to a second member, characterised in that the first member has a lug connected thereto, the second member has an recess which receives the lug in use, and wherein a clamping member is disposed between the lug and the second member, the clamping member including a resilient portion such that the supply of a compressive force to the resilient portion acts to restrain movement of the second member relative to the lug.

In accordance with a second aspect of the present invention there is provided an attachment system for connecting a first member to a second member, characterised in that the first member has a lug connected thereto, the second member has an recess which receives the lug in use, the recess including a slot arranged to receive a stabilizing member, and wherein a clamping member is disposed between the lug and the stabilizing member such that the supply of pressure to the clamping member acts to restrain movement of the second member relative to the lug.

BRIEF DESCRIPTION OF THE DRAWINGS

The present invention will now be described, by way of example, with reference to the accompanying drawings, in which.

DESCRIPTION OF THE INVENTION

Figure 1:
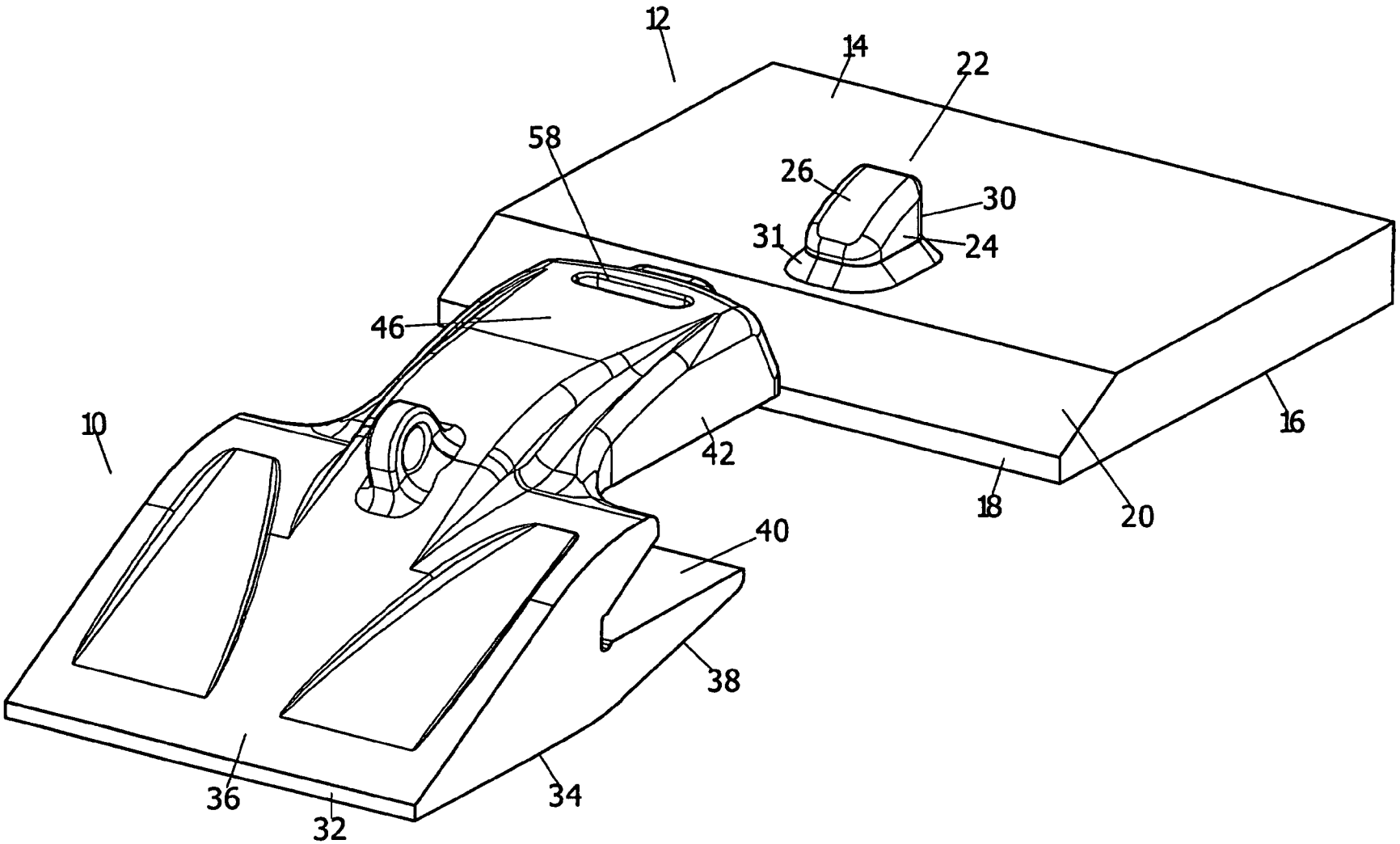
FIG. 1 is a perspective view of a ground engaging tool arranged to be attached to a lip plate (a portion of which is shown) in accordance with the present invention.
Figure 2:
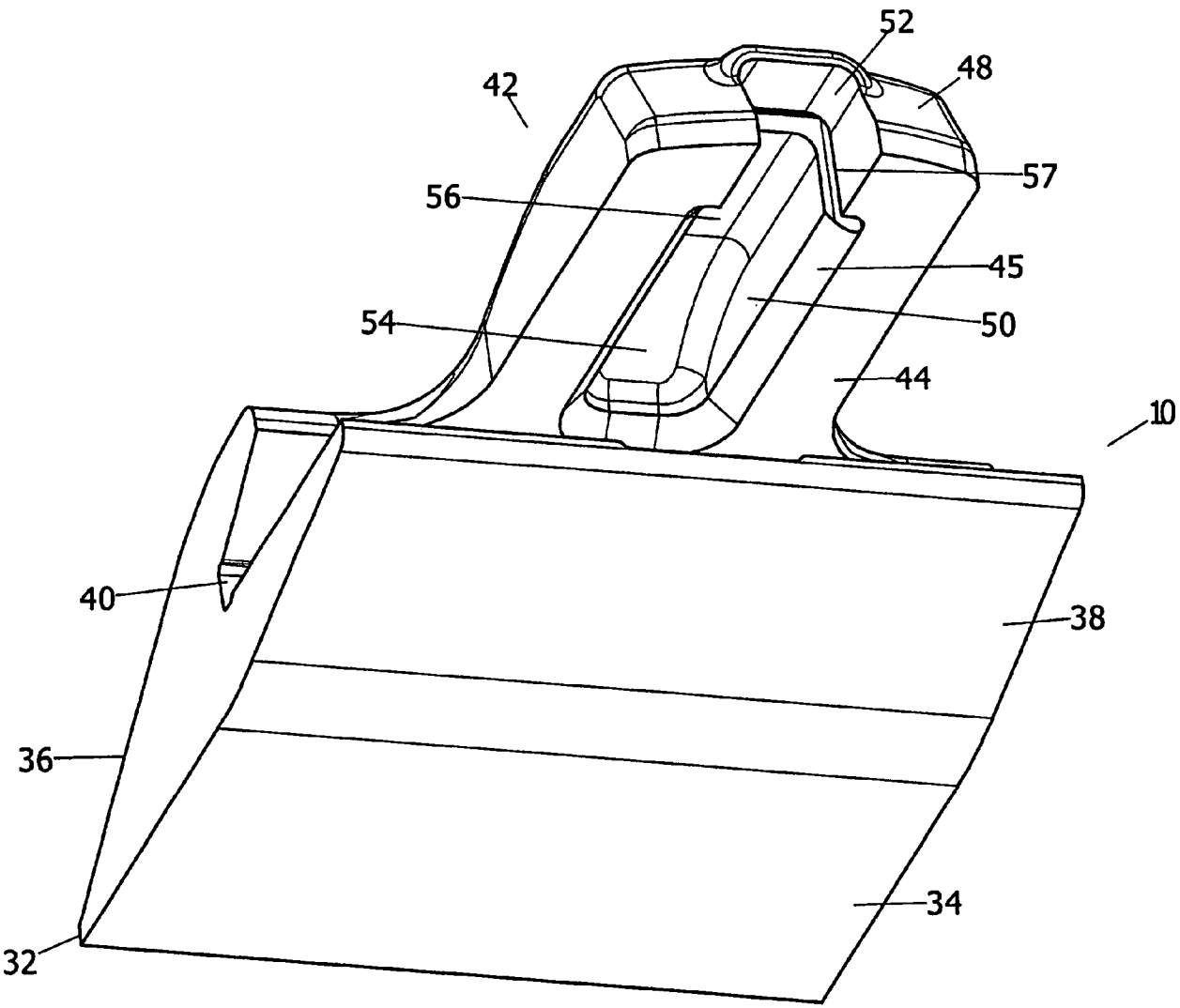
FIG. 2 is perspective view of the underside of the ground engaging tool of FIG. 1.
Figure 3:
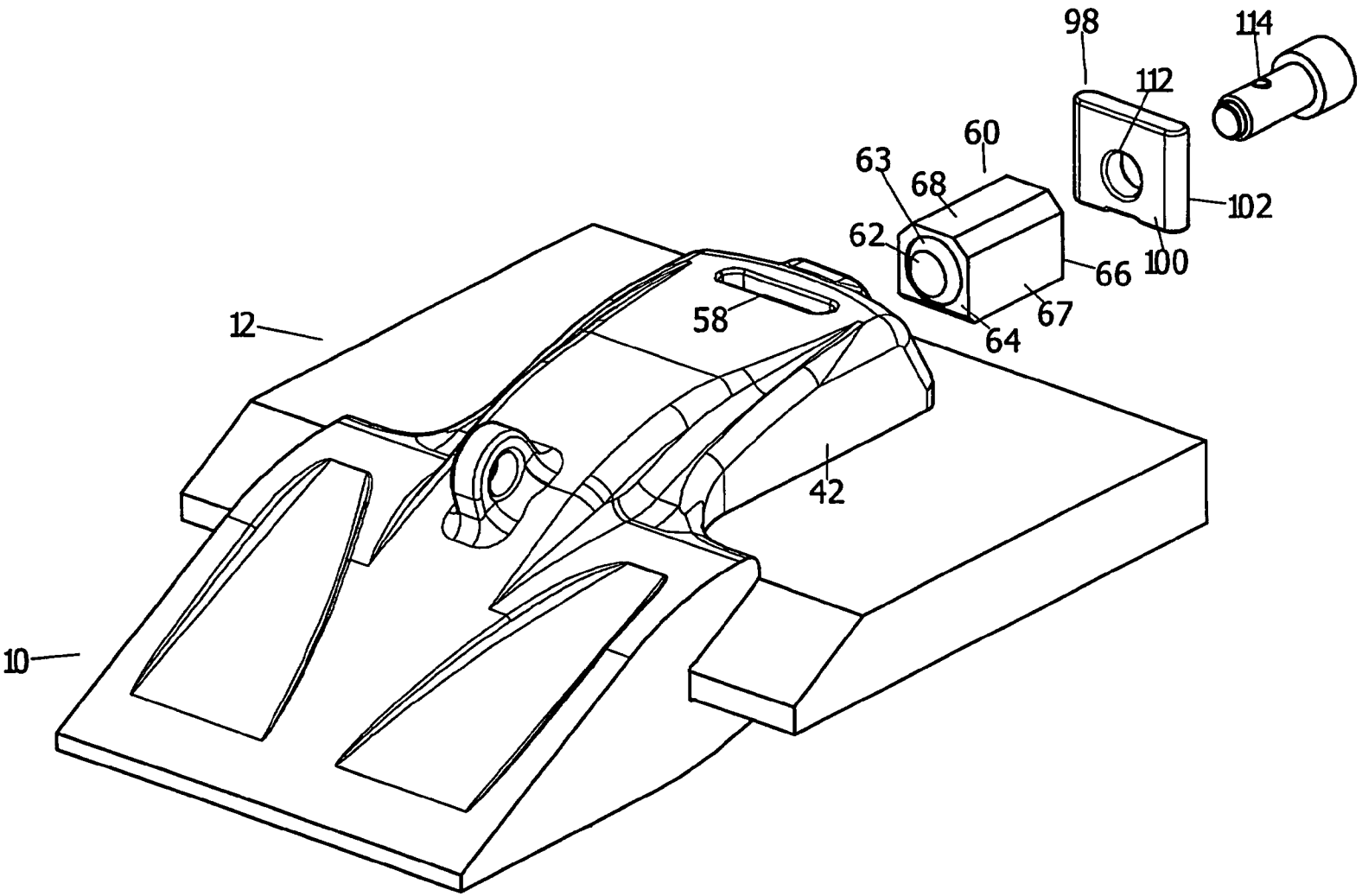
FIG. 3 is a perspective view of the ground engaging tool and lip plate portion of FIG. 1, shown during attachment, together with a clamping member in accordance with the present invention.

Referring to the Figures, there is shown a ground engaging tool 10 arranged to be attached to a portion of a lip plate 12. The lip plate 12 is substantially rectangular in cross section, and extends around the rim of a bucket (not shown) of a mechanical digging device. The lip plate 12 includes an upper face 14, a lower face 16 and an end face 18. A tapered surface 20 extends from the end face 18 of the lip plate 12 to the upper face 14.

The lip plate 12 includes a lug 22 affixed by suitable means to the upper face 14. In the embodiment shown in the drawings the lug 22 is affixed by a weld 31. The lug 22 is oriented towards the end face 18 of the lip plate 12, and includes a top surface 26 which curves upwardly in a convex fashion from a first end of the lug 22 adjacent the tapered surface 20 to a second end of the lug 22 remote from the tapered surface 20.

The lug 22 further includes a substantially flat rear face 30 at the second end of the lug 22, the rear face 30 extending from the top surface 26 to the upper face 14, and being substantially perpendicular to the upper face 14 and parallel to the end face 18.

The lug 22 has a side wall 24 which extends about the lug 22 and is bordered by the upper face 14, the top surface 26 and the rear face 30.

The ground engaging tool 10 comprises a leading edge 32, a first base portion 34 extending substantially perpendicularly of the leading edge 32, a front portion 36 extending away from the leading edge at a shallow angle, a second base portion 38 extending away from the first base portion 34 at a shallow angle, a transverse recess 40 disposed oppositely the leading edge 32 and an attachment portion 42. The front portion 36, leading edge 32 and the first base portion 34 co-operate to form a substantially V shaped working portion in order to penetrate, in use, the material being dug. The transverse recess 40 is complementary in shape to the lip plate 12, and allows the ground engaging tool 10 to be located on the perimeter of the lip plate 12 adjacent the end face 18. The second base portion 38 tapers from the first base portion 34 in a direction away from the leading edge 32, and ends, in use, adjacent the lip plate 12. The leading edge 32, first and second base portions 34 and 38 and the front portion 36 define a working portion of the ground engaging tool 10.

The attachment portion 42 extends from the front portion 36 adjacent the recess 40 in a direction away from the leading edge 32. It locates, in use, along the upper face 14 of the lip plate 12, and co-operates with the lug 22.

The attachment portion 42 has a substantially flat lower surface 44, a substantially flat upper surface 46 and a rear surface 48. The attachment portion 42 includes an engaging recess 50 extending inwardly of the rear surface 48 through a rear aperture 52 in the rear surface 48, and upwardly of the lower surface 44 through a lower aperture 45. The engaging recess 50 has a first portion 54 remote from the rear aperture 52, and a second portion 56 adjacent the rear aperture 52. The first portion 54 is complementary in shape to the lug 22, whereas the second portion 56 has substantially constant cross section. The second portion 56 is in the shape of a radiused rectangle in cross section, and is slightly larger in dimension than the rear face 30 of the lug 22. This allows, in use, the second portion 56 to be placed about the lug 22. This in turn allows the attachment portion 42 to be slid over the lug 22 in a longitudinal direction, and to locate in a position whereby the lug 22 is within the first portion 54 of the engaging recess 50. In this position relative movement of the attachment portion 42 and the lip plate 12 in a transverse direction is restricted.

The attachment portion 42 further includes a rectangular slot 57 which extends from an aperture 58 within the upper surface 46 to the lower surface 44. The rectangular slot 57 is arranged in a transverse direction, and is located within the second portion 56 of the engaging recess 50. The rectangular slot 57 is larger in the transverse direction than the second portion 56, and therefore forms a groove on either side of the second portion 56. The aperture 58 communicates with the second portion 56 of the engaging recess 50.

The attachment system further includes a clamping member 60. The clamping member 60 is shown in FIGS. 3 to 8.

The clamping member 60 is of complementary cross sectional shape to the second portion 56 of the engaging recess 50 and has a first side 64 which is arranged to locate adjacent the lug 22 and a second side 66 opposite the first side 64. The second side 66 is arranged to locate adjacent the rectangular slot 57. The clamping member 60 further includes side surfaces 67 and a top surface 68.

The clamping member 60 includes a substantially cylindrical chamber 80 extending within the clamping member 60 from the first side 64 to a rear wall 82.

The clamping member 60 further includes a substantially cylindrical lug engaging member 62. The lug engaging member 62 is substantially complementary in shape to, and contained within, the chamber 80. An outer portion 63 of the lug engaging member 62 extends from the first side 64 of the clamping member 60.

A resilient annular member such as an O-ring 65 is located within an groove about the chamber 80 adjacent the first side 64 of the clamping member 60.

The lug engaging member 62 includes a substantially cylindrical recess 81 extending inwardly of the lug engaging member 62 from a rear end of the lug engaging member 62 adjacent, in use, the rear wall 82 of the chamber 80.

A resilient portion 90 such as a compressible spring is located within the recess 81. In the embodiment of the drawings the resilient portion 90 comprises a plurality of Belleville type cylindrical washers, however it will be appreciated that other resilient elements such as coil springs, rubber or resilient plastic elements could be used.

A substantially cylindrical slot 110 extends from the chamber 80 adjacent a rear end of the lug engaging member 62 to the second side 66 of the clamping member 60. The slot 110 is internally threaded.

The attachment system further includes a stabilizing member 98. The stabilizing member 98 is in the form of a prism, having front and rear faces 100, 102. The stabilizing member 98 is substantially the same shape as the rectangular slot 57.

The stabilizing member 98 has a substantially cylindrical aperture 112 which is arranged to locate, in use, adjacent the slot 110 of the clamping member 60 so as to form a single cylindrical passageway. The cylindrical aperture 112 may be threaded.

A compressing member in the form of a substantially cylindrical bolt 114 is arranged, in use, to locate within the passageway formed by the slot 110 and the aperture 112.

The bolt is externally threaded, and is arranged to engage with the internally threaded slot 110. The bolt acts to hold the stabilizing member 98 relative to the clamping member 60 during use. It will be appreciated that other means may be used to provide a compressive force such as a hydraulically operated piston.

The use of the clamping member 60 will now be described.

Figure 4:
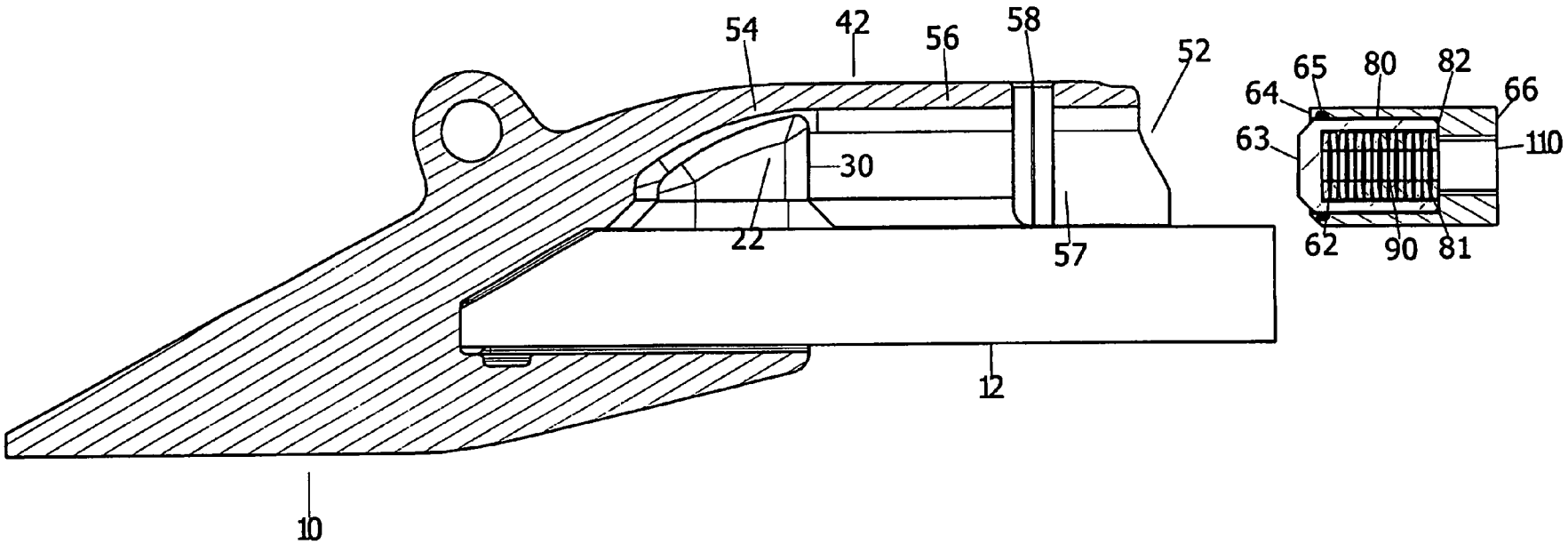
FIGS. 4 to 8 are sequential cross sectional views of a portion of the ground engaging tool and lip plate of FIGS. 1 to 3 during the attachment process.

The attachment portion 42 is positioned over the lip plate 12 with the lug 22 located within the first portion 54 of the engaging recess 50. This is shown in FIG. 4.

The clamping member 60 is then introduced through the rear aperture 52 and slid forward relative to the attachment portion 42 until the first side 64 is adjacent the rear face 30 of the lug 22, and the clamping member 60 is free of the rectangular slot 57.

Figure 5:
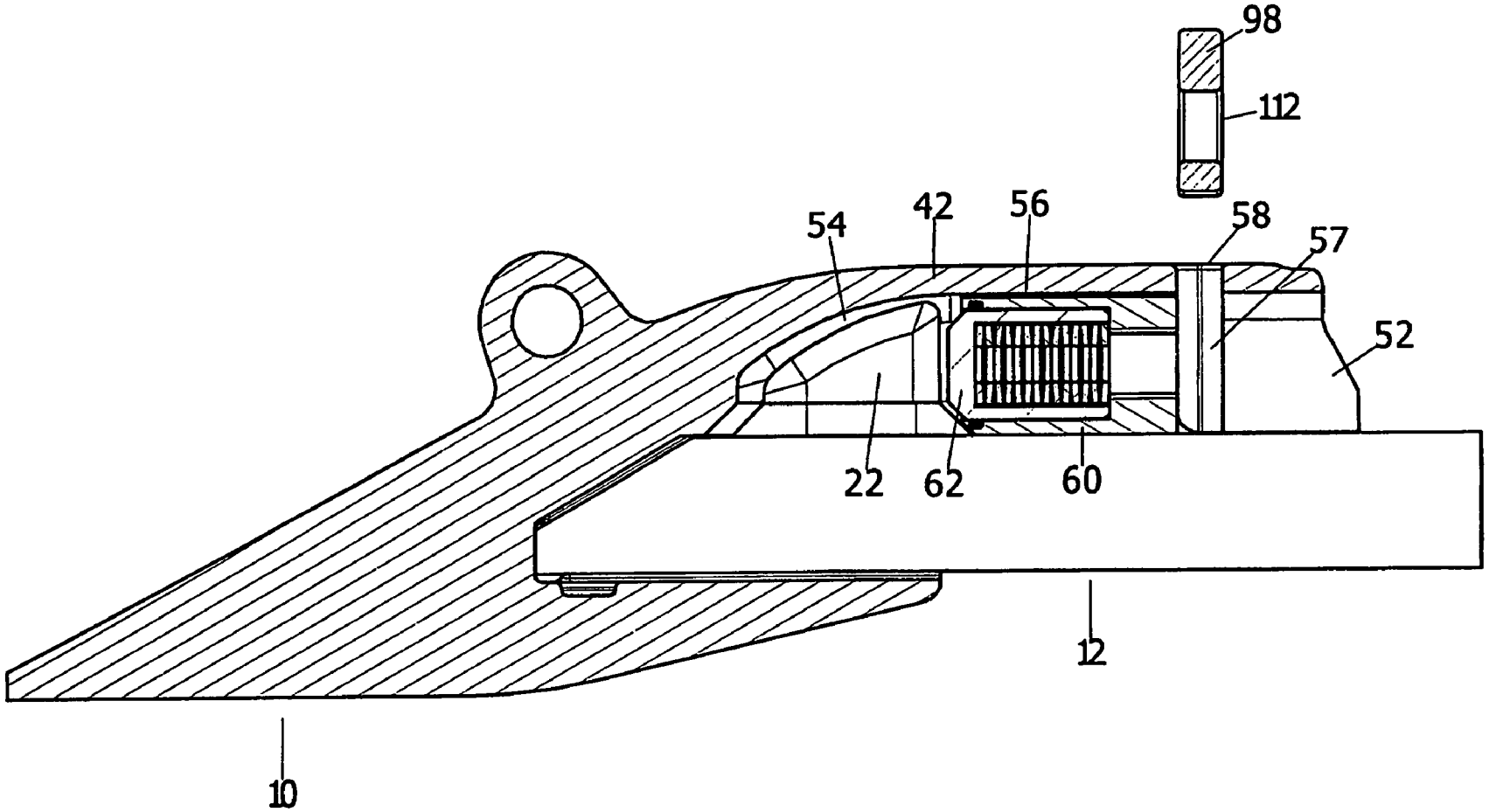

This is shown in FIG. 5.

Figure 6:
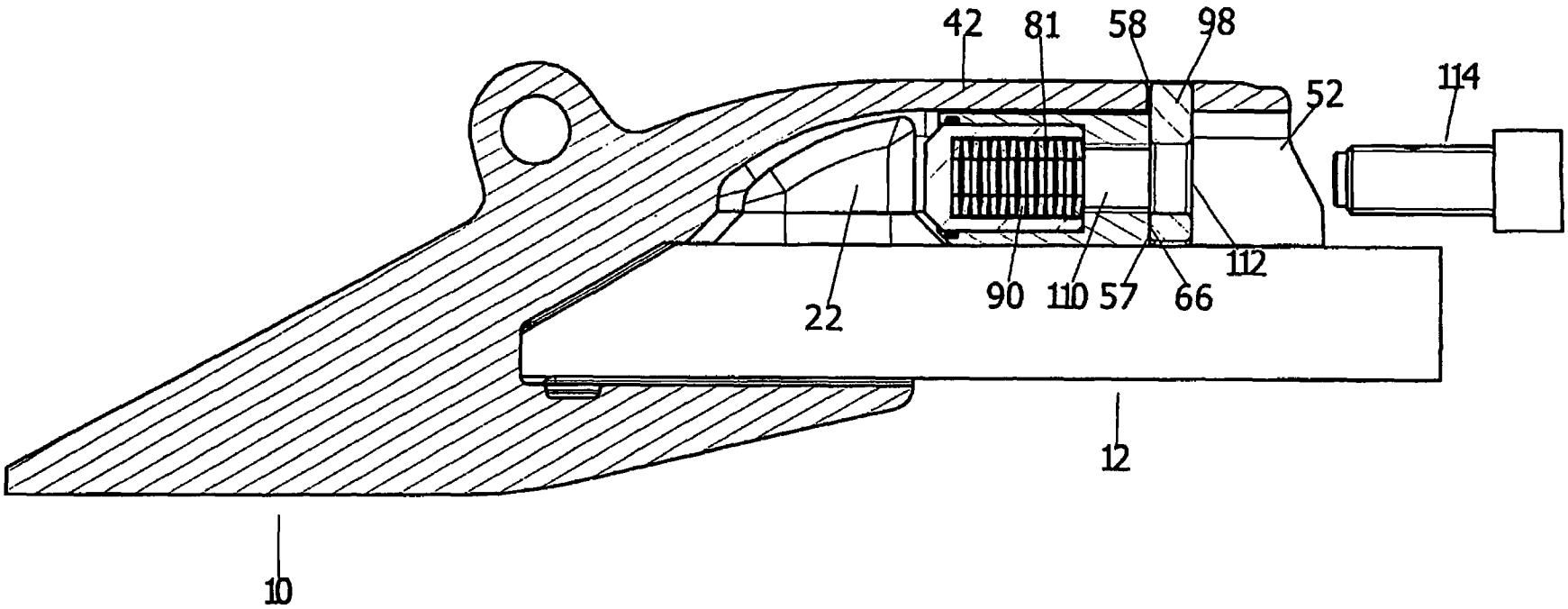

The stabilizing member 98 is then introduced into the aperture 58, and positioned in the rectangular slot 57 between the second side 66 of the clamping member 60 and the rear aperture 52. The presence of the stabilizing member 98 in the slot 57 prevents the movement of the clamping member 60 in the longitudinal direction. This is shown in FIG. 6.

Figure 7:
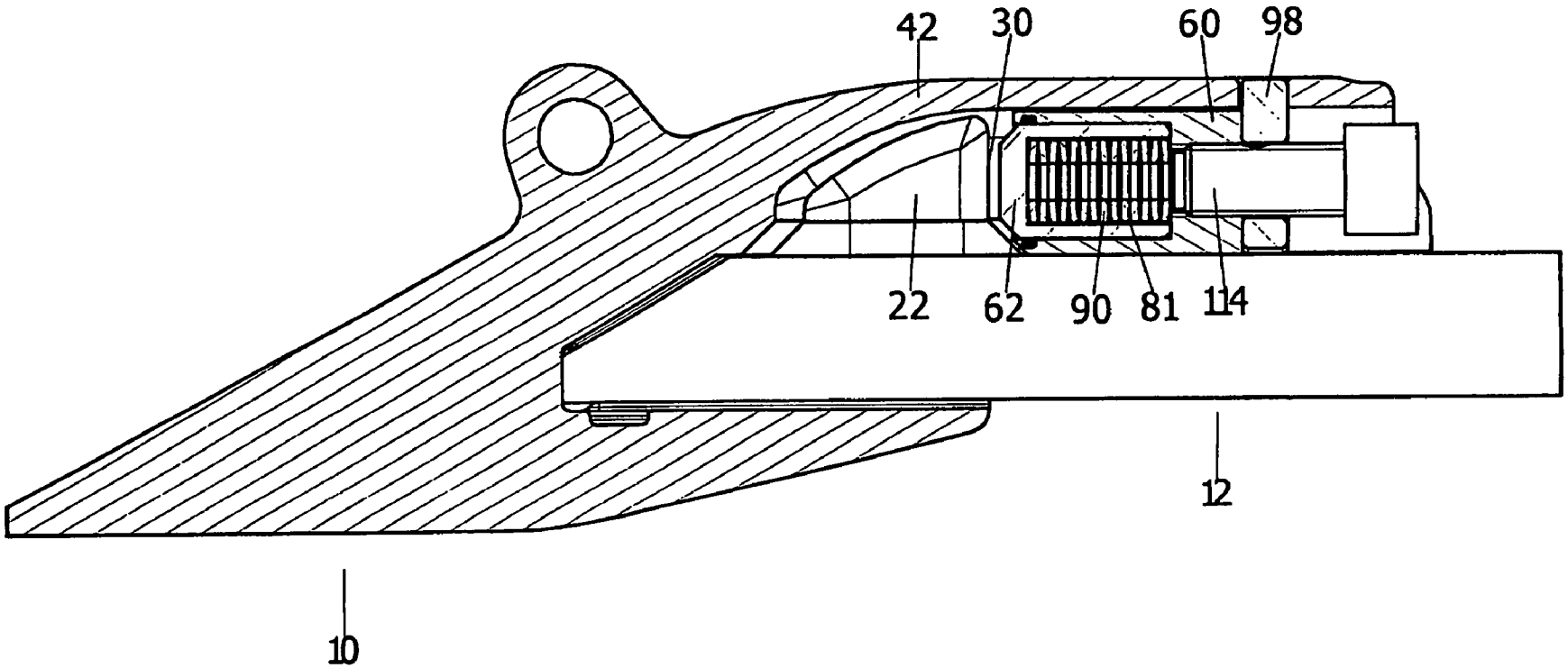

The clamping member is activated as follows. The bolt 114 is introduced into the passage created by the slot 110 and the aperture 112, and is threadedly engaged with the slot 110. When the bolt 114 is fully within this passage, the end of the bolt 114 is adjacent the resilient portion 90. The application of a turning force to the bolt so as to promote the advance of the bolt into the recess 81 provides a compressive force on the resilient portion 90. This is shown in FIG. 7.

Figure 8:
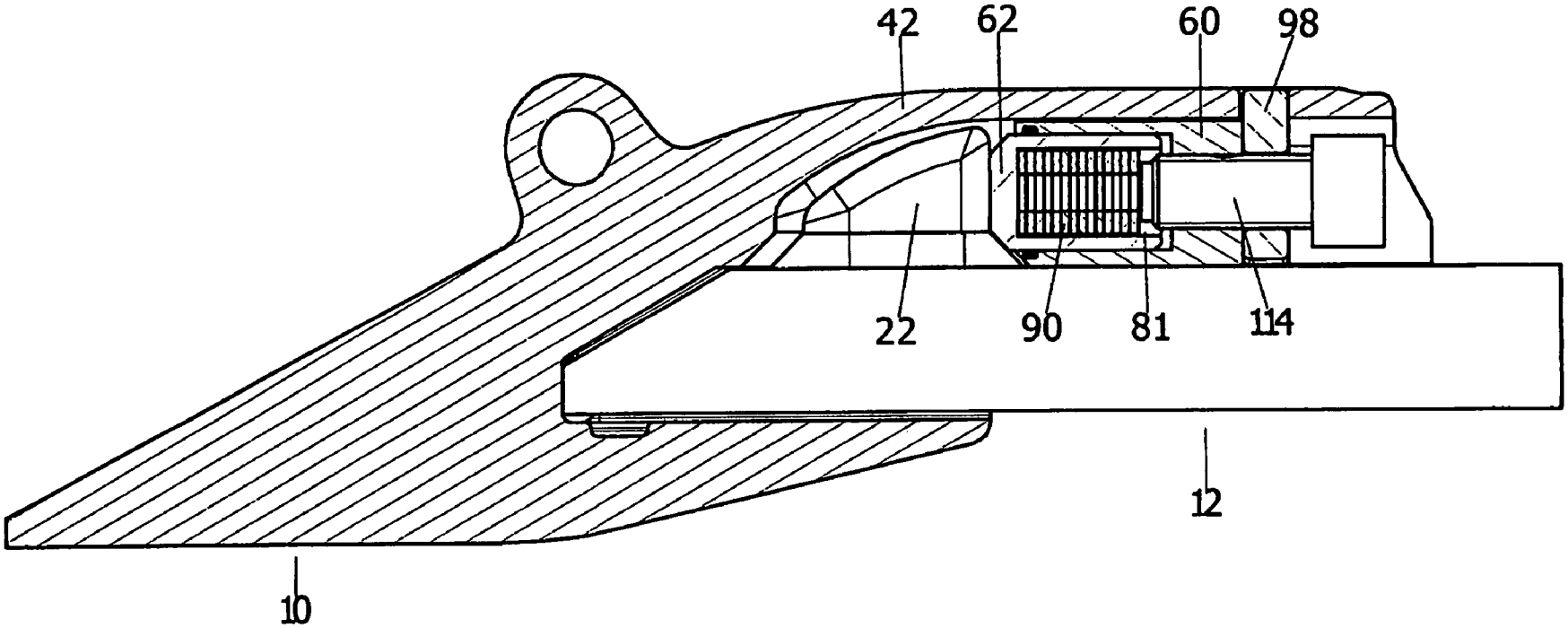

The effect of the compressive force on the resilient portion 90 is to cause lug engaging member 62 to apply a compressive force against the rear face 30 of the lug 22. In this way a compressive force is applied between the lug 22 and the attachment portion 42, thus locking the ground engaging tool 10 in position relative to the lip plate 12. This final position is shown in FIG. 8.

When it is desired to remove the ground engaging tool 10 from the lip portion 12, the bolt 114 is unscrewed from the slot 110, thus releasing the compressive force from the resilient portion 90 of the lug engaging portion 62. The attachment portion 42 can then be readily removed from the lip portion 12 in the reverse of the above process, potentially allowing some members to be reused.

Modifications and variations as would be apparent to a skilled addressee are deemed to be within the scope of the present invention. For instance, the resilient portion 90 may be located externally of the recess 81.

The invention clamed is:

1. An attachment system for connecting a lip plate of a digging device to a ground engaging tool, comprising:

a lug mounted on the lip plate and including a rear face;

an engaging recess arranged in a rearwardly extending attachment portion of the ground engaging tool, extending inwardly of the attachment portion from a rear surface thereof, the engaging recess being arranged to received the lug;

a lug engaging member insertable into the engaging recess from the rear surface of the attachment portion, the lug engaging member arranged to engage the rear face of the lug;

a clamping member arranged to be received longitudinally in the engaging recess, the clamping member comprising a substantially cylindrical chamber housing the lug engaging member;

a resilient member coupled to the lug engaging member opposite the lug; and a compressive member at least partially insertable into the engaging recess from the rear surface of the attachment portion to apply a compressive force to the resilient member to engage the lug engaging member with the rear face of the lug and restrain a longitudinal movement of the lug relative to the ground engaging tool.

2. An attachment system according to claim 1, wherein the clamping member comprises a front wall and an outer portion of the lug engaging member extends outwardly from the front wall.

3. An attachment system according to claim 1, wherein the substantially cylindrical chamber comprises a rear wall arranged to received the compressive force through an aperture arranged on the rear wall.

4. An attachment system according to claim 1, wherein the lug engaging member comprises a substantially cylindrical recess extending inwardly from a rear end thereof, wherein the resilient member is mounted in the substantially cylindrical recess of the lug engaging member.

5. An attachment system according to claim 1, wherein the lug engaging chamber comprises a rear wall including a slot, the lug engaging chamber being arranged to receive the compressive force through the slot, the slot being internally threaded and arranged to receive a threaded bolt, the bolt being threadably engaged within the slot to apply compressive force to the resilient member upon application of a turning force to press the lug engaging member into engagement with the lug.

6. An attachment system according to claim 1, further comprising a stabilizing member arranged to prevent an outward longitudinal movement of the clamping member.

7. An attachment system according to claim 6, further comprising an aperture extending from an upper surface of the attachment portion and communicating with the engaging recess, wherein the stabilizing member is insertable through the aperture into the engaging recess to engage with the clamping member, thereby preventing outward longitudinal movement of the clamping member from the engaging recess.

8. An attachment system according to claim 7, wherein an inner wall of the engaging recess is grooved.

9. An attachment system according to claim 7, wherein the stabilizing member comprises a second aperture arranged in alignment with the aperture.

10. An attachment system according to claim 1, wherein the engaging recess comprises:

an open lower end;

a first portion remote from the rear surface of the attachment portion, the first portion being complementary in shape to the lug to receive the lug; and a second portion adjacent the rear surface of the attachment portion, the second portion having a substantially constant cross section of slightly larger dimension than the lug to be placed about the lug to restrict a lateral relative movement of the ground engaging tool and the lip plate.

11. A ground engaging tool for connection to a lip plate, the lip plate including a lug mounted thereon, the ground engagement tool comprising:

a rearwardly extending attachment portion having a rear surface and containing an engaging recess extending inwardly of the attachment portion from the rear surface, the engaging recess being arranged to received the lug;

a lug engaging member insertable into the engaging recess from the rear surface of the attachment portion, the lug engaging member arranged to engage a rear face of the lug;

a clamping member arranged to be received longitudinally in the engaging recess, the clamping member comprising a substantially cylindrical chamber containing the lug engaging member;

a resilient member coupled to the lug engaging member opposite the lug; and a compressive member at least partially insertable into the engaging recess from the rear surface of the attachment portion to apply a compressive force to the resilient member to engage the lug engaging member with the rear face of the lug and restrain a longitudinal movement of the lug relative to the ground engaging tool.

12. A ground engaging tool according to claim 11, wherein the clamping member comprises a front wall and an outer portion of the lug engaging member extends outwardly from the front wall.

13. A ground engaging tool according to claim 11, wherein the substantially cylindrical chamber comprises a rear wall arranged to received the compressive force through an aperture arranged on the rear wall.

14. A ground engaging tool according to claim 11, wherein the lug engaging member comprises a substantially cylindrical recess extending inwardly from a rear end thereof, wherein the resilient member is mounted in the substantially cylindrical recess.

15. A ground engaging tool according to claim 14, wherein the lug engaging chamber comprises a rear wall including a slot, the lug engaging chamber being arranged to receive the compressive force through the slot, the slot being internally threaded and arranged to receive a threaded bolt, the bolt being threadably engaged within the slot to apply compressive force to the resilient member upon application of a turning force to press the lug engaging member into engagement with the lug.

16. A ground engaging tool according to claim 11, further comprising a stabilizing member arranged to prevent an outward longitudinal movement of the clamping member.

17. A ground engaging tool according to claim 16, further comprising an aperture extending from an upper surface of the attachment portion and communicating with the engaging recess, wherein the stabilizing member is insertable through the aperture into the engaging recess to engage with the clamping member, thereby preventing outward longitudinal movement of the clamping member from the engaging recess.

18. A ground engaging tool according to claim 17, wherein an inner wall of the engaging recess is grooved.

19. A ground engaging tool according to claim 17, wherein the stabilizing member comprises a second aperture arranged in alignment with the aperture.

20. A ground engaging tool according to claim 11, wherein the engaging recess comprises:

an open lower end;

a first portion remote from the rear surface of the attachment portion, the first portion being complementary in shape to the lug to receive the lug; and a second portion adjacent the rear surface of the attachment portion, the second portion having a substantially constant cross section of slightly larger dimension than the lug to be placed about the lug to restrict a lateral relative movement of the ground engaging tool and the lip plate.

* * * * *